US006547119B2

(12) United States Patent
Huang

(10) Patent No.: US 6,547,119 B2
(45) Date of Patent: Apr. 15, 2003

(54) POWER STAPLER

(76) Inventor: Chien Kai Huang, No. 136, Tsu Chiang Road, Changhua City (TW)

( * ) Notice: Subject to any disclaimer, the term of this patent is extended or adjusted under 35 U.S.C. 154(b) by 65 days.

(21) Appl. No.: 09/843,720

(22) Filed: Apr. 30, 2001

(65) Prior Publication Data

US 2002/0158101 A1 Oct. 31, 2002

(51) Int. Cl.[7] ..... B27F 7/19
(52) U.S. Cl. ..... 227/7; 227/131; 227/155
(58) Field of Search ..... 227/5, 6, 7, 131, 227/155

(56) References Cited

U.S. PATENT DOCUMENTS 5,029,745 A * 7/1991 Akizawa et al. ..... 227/131
5,222,645 A * 6/1993 Sueda ..... 227/7
5,427,296 A * 6/1995 Chen ..... 227/131
5,474,222 A * 12/1995 Kanai et al. ..... 227/131
5,657,918 A * 8/1997 Shimomura et al. ..... 227/7
5,791,544 A * 8/1998 Fujimaki ..... 227/7
5,803,337 A * 9/1998 Fukai et al. ..... 227/7

* cited by examiner

*Primary Examiner*—Scott A. Smith
(74) *Attorney, Agent, or Firm*—Bacon & Thomas

(57) ABSTRACT

A power stapler includes a base in which a gear system and a motor is received, and a punching arm which is pivotally connected to the base and a punching member is pivotally connected to the base. A punching plate is connected a free end of the punching member. A shaft extends through the punching member and two arms are connected to two first ends of the shaft. Two cam devices are respectively connected to two respective second ends of the two arms and the gear system powered by a motor is connected to an axle of one gear of the gear system. Accordingly, when the two arms are activated by the gear system, the punching member is lowered to proceed stapling action.

3 Claims, 6 Drawing Sheets

POWER STAPLER

FIELD OF THE INVENTION

The present invention relates to a stapler powered by a motor and the punching member is connected by two arms which are moved by a cam device so that the lowering action of the punching member is evenly and in stable.

BACKGROUND OF THE INVENTION

A conventional power stapler 70 is shown in FIGS. 6 and 7 and generally includes a punching member 76 which is pivotally connected to an inside of an arm of the stapler 70 and staples are received in the punching member 76. A motor 71 is connected in the power stapler 70 and is connected to a gear system 72. A pinion T7 driven by the motor 71 is connected to a gear T8 and a gear disk T10 is co-axially connected to the gear T8 and drives gear T9. A gear disk T11 is co-axially connected to the gear T9 and drives a gear disk T12. A shaft 73 extends from a side of the gear T12 and a cam shaft 74 is connected to the shaft 73. A cam 75 is connected to the cam shaft 74 and is retained in a semi-circular frame 77 and when the cam 75 is at its high position, the punching member 76 is positioned at not-in-use position. When documents are inserted into the space below the punching member 76, the cam 75 is moved to its lowest position by the gear system 72 to press the punching member 76 downward and penetrate a staple through the documents. However, the cam 75 contacts a side on the top of the punching member 76 so that the punching member 76 is applied an eccentric force which tends to tort the punching member 76 and the force of the two ends of the staple are not evenly. Because the cam shaft 74 is cantilevered so that it is worn out and/or deformed after being used for a long period of time. The contact between the cam 75 and the punching member 76 is an impact type that accelerates the deformation of the cam shaft 74.

The present invention intends to provide a power stapler wherein the punching member is connected between two arms and two cam devices are connected on two distal ends of the two arms so that the punching member can be smoothly lowered and raised.

SUMMARY OF THE INVENTION

In accordance with one aspect of the present invention, there is provided a power stapler and includes a base and a punching arm is pivotally connected to said base in which a gear system and a motor powering the gear system are received. A punching member has an end pivotally connected to said base and a punching plate extends from the other end of said punching member. A shaft extends through said punching member and two arms each have a first end thereof connected to two ends of said shaft. Two cam devices are respectively connected to two respective second ends of said two arms. The two cam devices are connected to an axle of one gear of said gear system so that when the gear is rotated, the cam devices moves the two arms.

The primary object of the present invention is to provide a power stapler wherein the punching member is connected between two arms which have two respective cam devices connected with the gear system so that the punching member can be pivoted smoothly and in stable.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
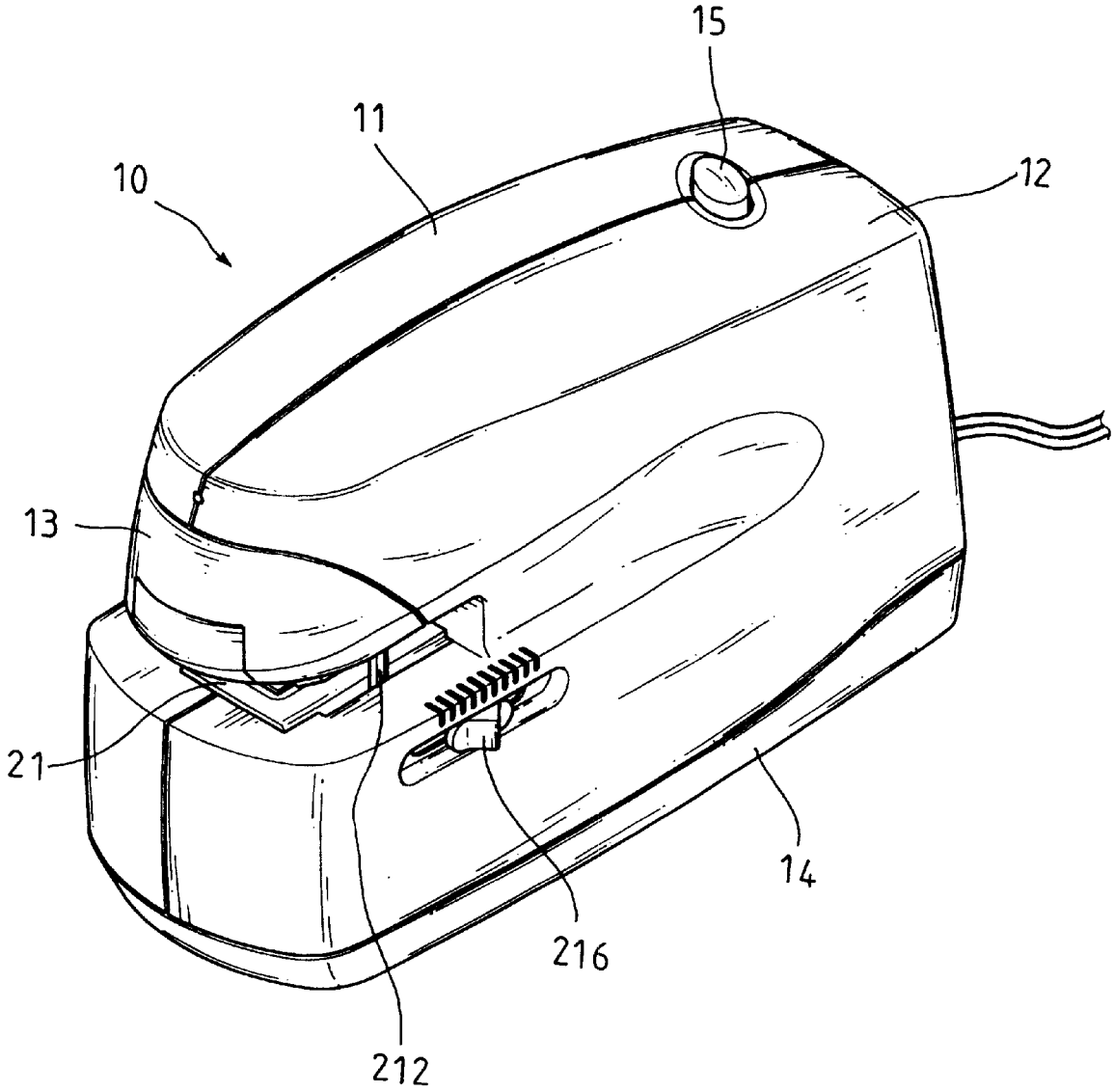
FIG. 1 is a perspective view to show the power stapler of the present invention.
Figure 2:
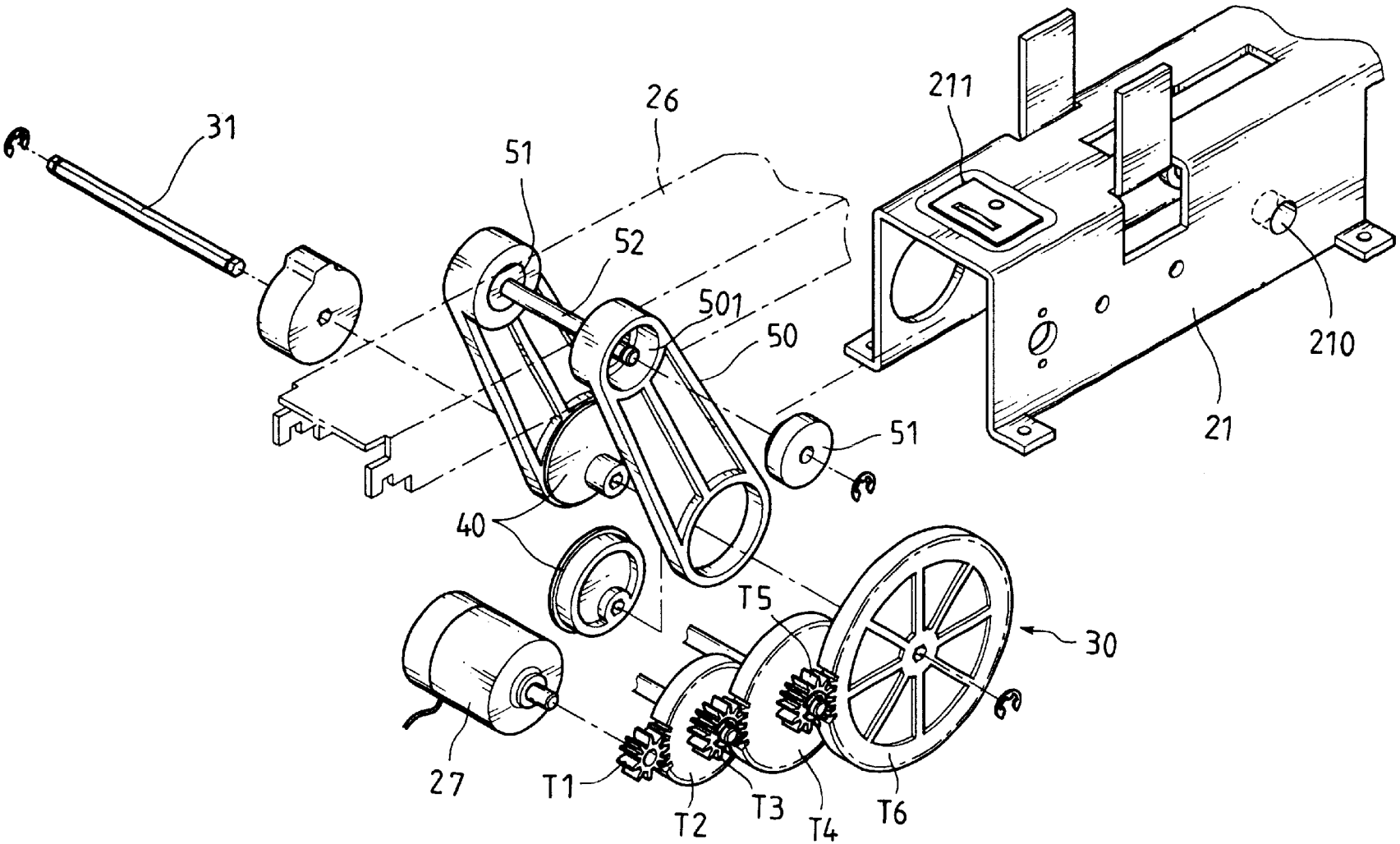
FIG. 2 is an exploded view to show the power stapler of the present invention.
Figure 3:
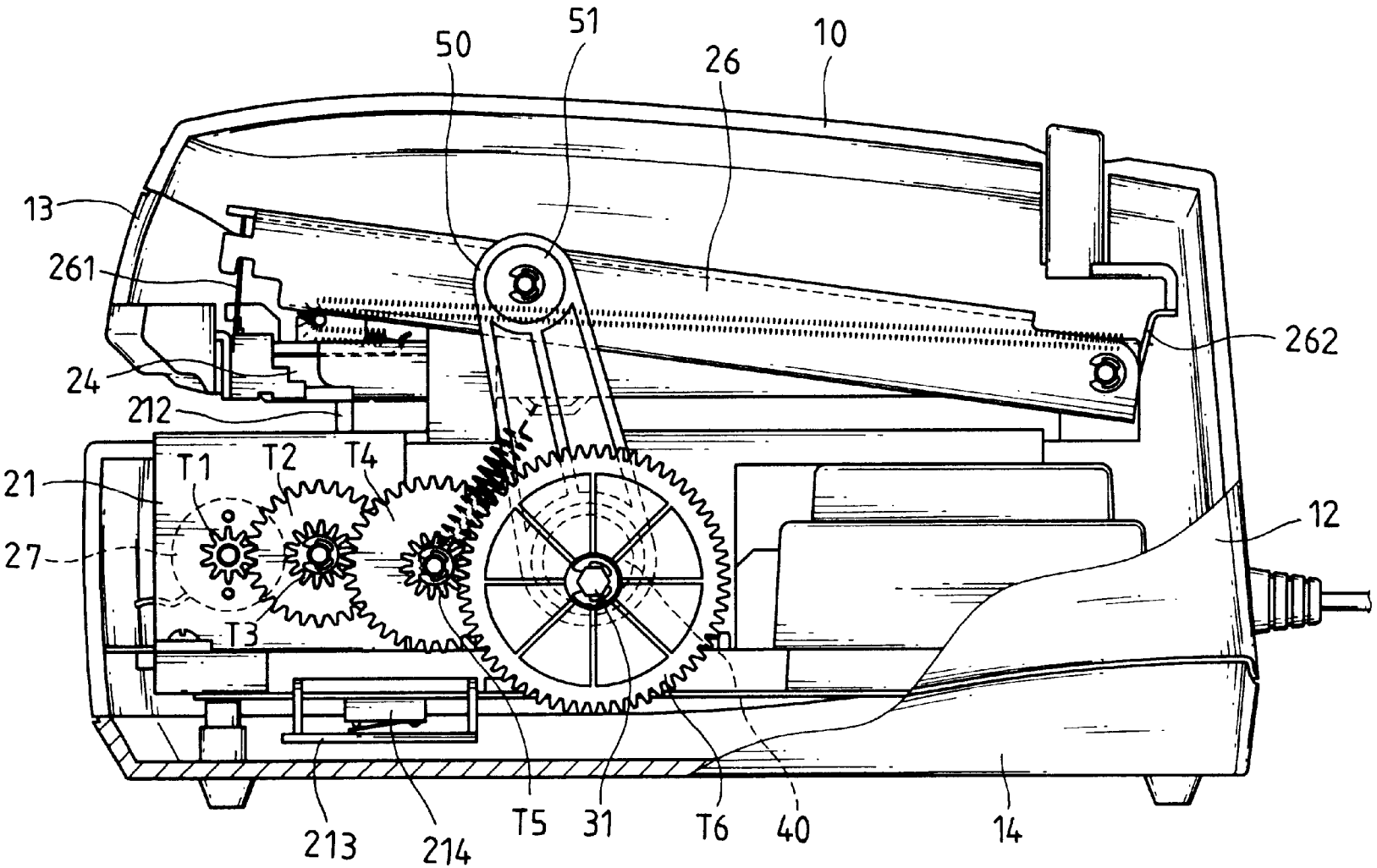
FIG. 3 is a side view to show the power stapler of the present invention.

Referring to FIGS. 1 to 3, the power stapler of the present invention comprises a base 14 and a punching arm 10 is pivotally connected to said base 14. The punching arm 10 is composed of three parts 11, 12, 13 and a release button 15 is accessed on the top of the punching arm 10. A frame 21 is received in the base 14 and has a matrix anvil 211 so as to bend two legs of staples.

A punching member 26 has an end pivotally connected to said base 14 and a punching plate 261 extends from the other end of said punching member 26 and is located corresponding to the matrix anvil 211. The punching plate 261 ejects one of the staples received in the punching member 26 toward the matrix anvil 211 when the punching member 26 is lowered. A shaft 52 extends transversely through said punching member 26 and two arms 50 each have a first end thereof connected to two ends of said shaft 52. Two cushion members 51 are received in two respective recesses 501 of the first ends of the two arms 50. Two cam devices 40 are respectively connected to two respective second ends of said two arms 50 and a polygonal shaft 31 extends through two holes 210 in the frame 21 and is connected to a final gear T6 of a gear system 30 received in the base 14. The gear system 30 includes a pinion T1 which is connected to an output shaft of a motor 27 and a second gear T2 is engaged with the pinion T1. A pinion T3 is co-axially connected to the second gear T2 and the pinion T3 is engaged with a third gear T4. A pinion T5 co-axially connected to the third gear T4 and a pinion T5 is co-axially connected to the third gear T4. The pinion T5 is engaged with the final gear T6. The release button 15 contacts a fulcrum member 262 which is pivoted when pushing the release button 15 so as to release a staple pushing plate 24 to allow the user to add the staples. A gap is defined between the punching arm 10 and the base 14 so that documents to be stapled can be inserted in the gap.

Figure 5A:
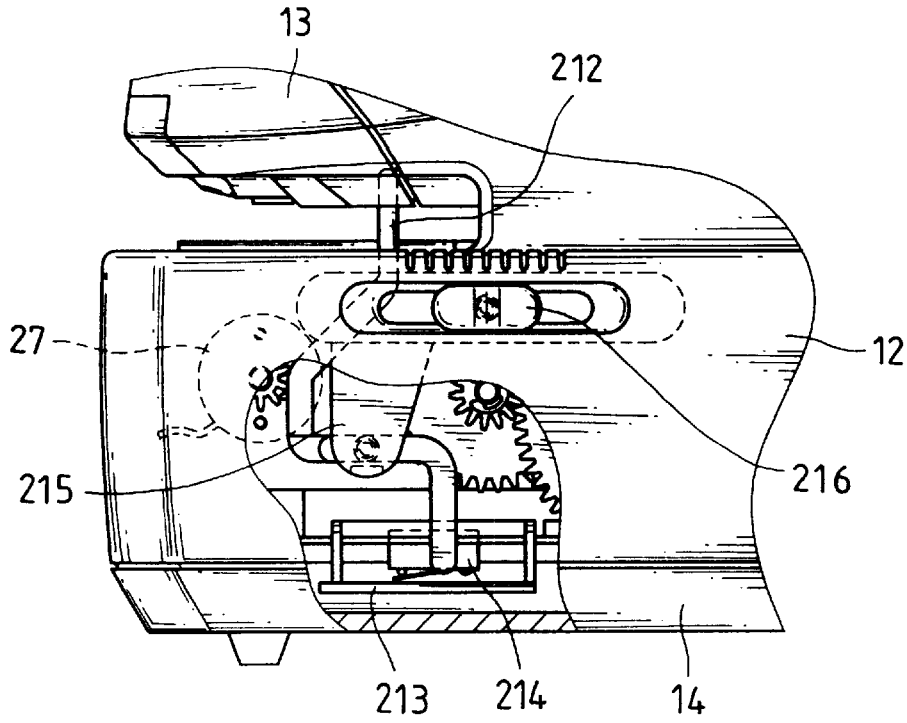
FIG. 5A is a plan view to show a pin member and a switch of the power stapler of the present invention.

As shown in FIG. 5A, a slide plate 215 is connected to the base 14 and a pin member 212 is pivotally connected to said slide plate 215. A first end of said pin member 212 is located in the gap between said punching arm 10 and said base 14, and a second end of said pin member 212 is engaged with a first end of a pivotable member 213 and a second end of the pivotable member 213 is engaged with a switch 214 for activating said motor 27. The base 14 has a slot defined in a side thereof and a knob 216 is slidably received in said slot. The knob 216 is connected to said slide plate 215 so that when sliding the knob 216, the first end of the pin member 212 is moved in the gap so as to decide a width from a edge of the documents 60 where the staples penetrate.

Figure 4:
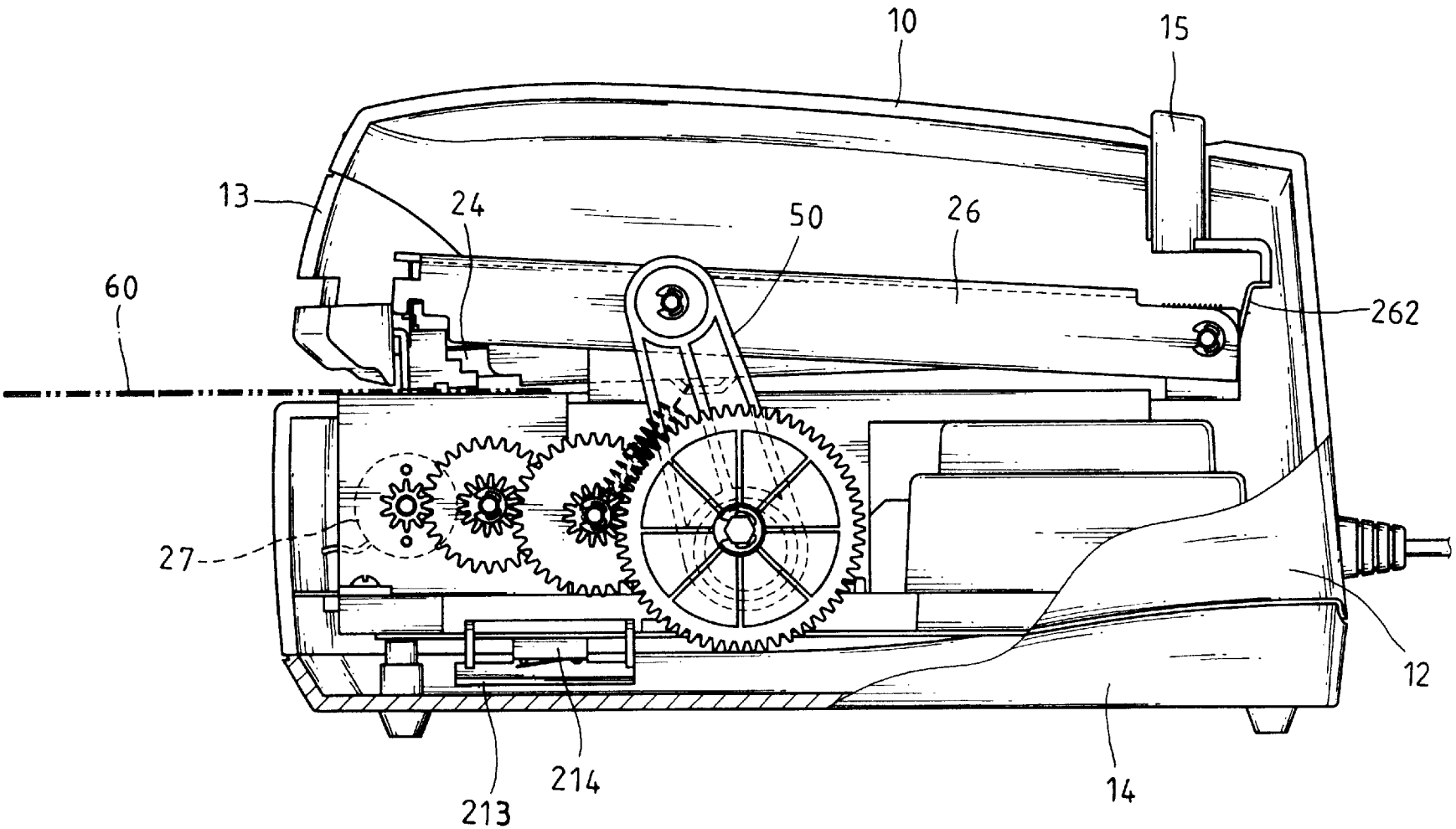
FIG. 4 is a side view to show the power stapler of the present invention wherein the punching member is lowered.
Figure 5B:
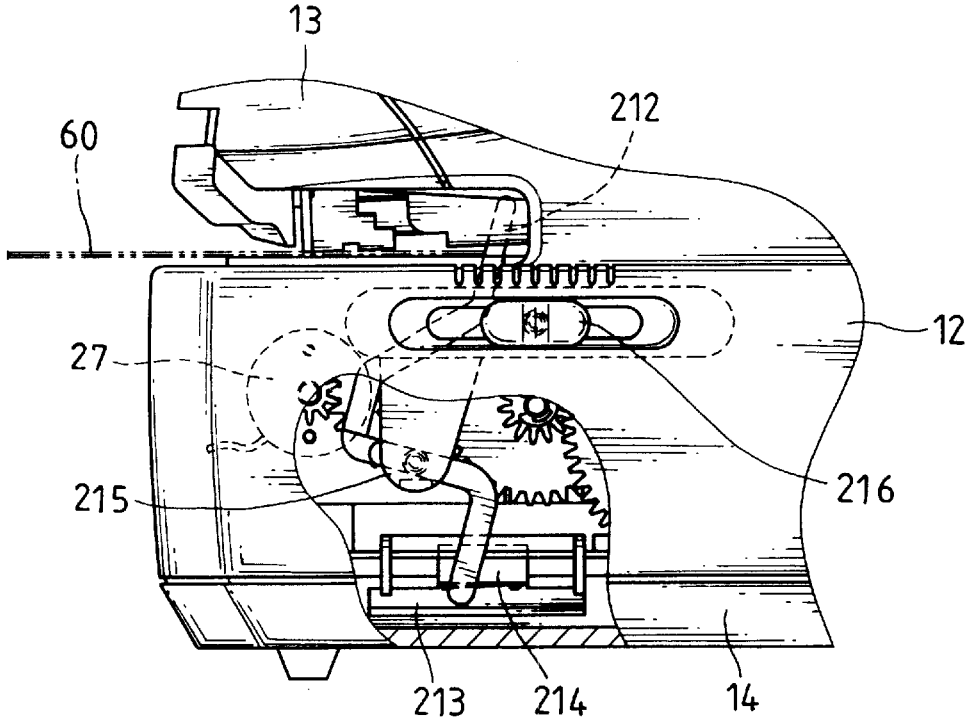
FIG. 5B is a plan view to show the pin member is pushed by documents to be stapled and the switch is activated.
Figure 6:
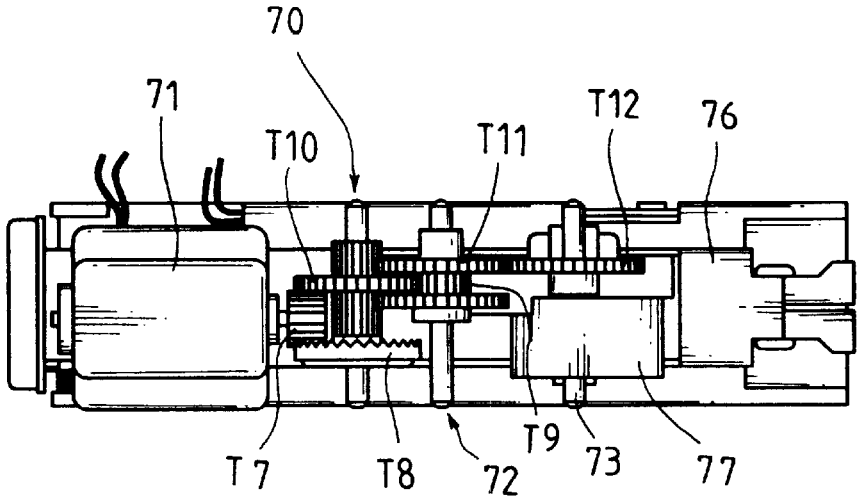
FIG.6 PRIOR ART
FIG. 6 is a top view to show the gear system of a conventional power stapler.
Figure 7:
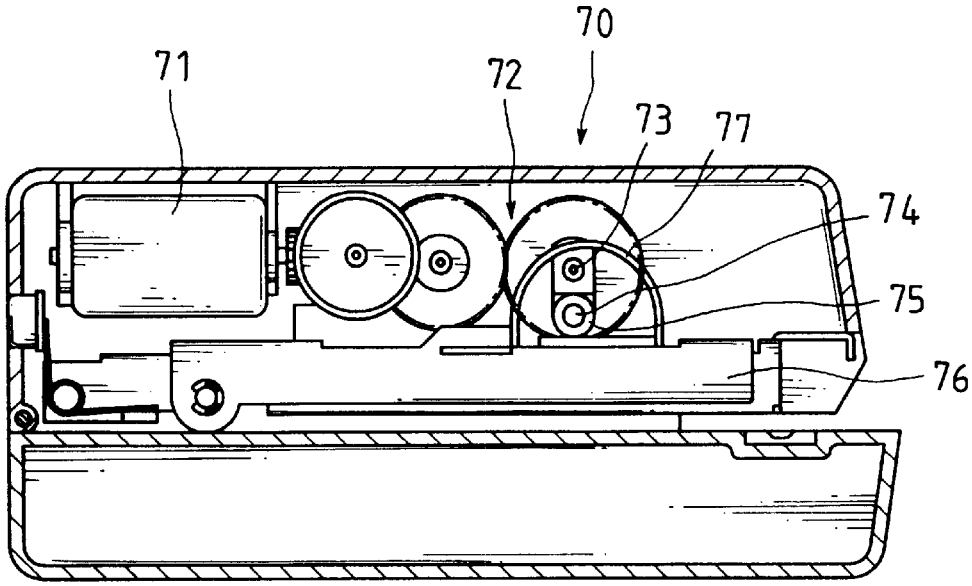
FIG.7 PRIOR ART
FIG. 7 is a side view to show the gear system of the conventional power stapler.

As shown in FIGS. 4 and 5B, when the first end of the pin member 212 is pushed by the documents 60 to be stapled, the second end of the pin member 212 is swung and pushes the first end of the pivotable member 213, the second end of the pivotable member 213 is then raised to compress and activate the switch 214 to operate the gear system 30 to lower the punching arm 10 to staple the documents. Because the punching member 26 is moved by the shaft 52 and the punching member 26 is connected between the two arms 50 so that when the two arms 50 are rotated, the punching member 26 is applied an even pull force on a top thereof and pivoted in stable.

While we have shown and described the embodiment in accordance with the present invention, it should be clear to those skilled in the art that further embodiments may be made without departing from the scope of the present invention.

What is claimed is:

1. A power stapler comprising:

a base (14) and a punching arm (10) connected to said base (14);

a punching member (26) having an end pivotally connected to said base (14) and a punching plate (261) connected to the other end of said punching member (26), a shaft (52) extending through said punching member (26) and two arms (50) each having a first end thereof connected to said shaft (52), two cam devices (40) respectively connected to each respective second end of said two arms (50), and a gear system (30) received in said base (14) and powered by a motor (27), said two cam devices (40) connected to an axle of one gear of said gear system (30).

2. The power stapler as claimed in claim 1 wherein said base (14) has a slide plate (215) and a pin member (212) is pivotally connected to said slide plate (215), a first end of said pin member (212) located in a gap between said punching arm (10) and said base (14), a second end of said pin member (212) engaged with a switch (214) for activating said motor (27).

3. The power stapler comprising:

a base (14 and a punching arm (10) connected to said base (14);

a punching member (26) having an end pivotally connected to said base (14) and a punching plate (261) connected to the other end of said punching member (26), a shaft (52) extending through said punching member (26) and two arms (50) each having a first end thereof connected to said shaft (52), two cam devices (40) respectively connected to each respective second end of said two arms (50), and a gear system (30) received in said base (14) and powered by a motor (27), said two cam devices (40) connected to an axle of one gear of said gear system (30); and wherein said base (14) has a slide plate (215) and a pin member (212) is pivotally connected to said slide plate (215), a first end of said pin member (212) located in a gap between said punching arm (10) and said base (14), a second end of said pin member (212) engaged with a switch (214) for activating said motor (27), and wherein said base (14) has a slot and a knob (216) is slidably received in said slot, said knob (216) connected to said slide plate (215).

* * * * *